United States Patent [19]

Poirier et al.

[11] 4,123,687

[45] Oct. 31, 1978

[54] DISPLAY SYSTEM USING LOW ENERGY ELECTRONS

[75] Inventors: Raymond Poirier; Nicolas Szydlo, both of Paris, France

[73] Assignee: Thomson-CSF, Paris, France

[21] Appl. No.: 798,568

[22] Filed: May 19, 1977

[30] Foreign Application Priority Data

May 21, 1976 [FR] France ..... 76 15516

[51] Int. Cl.[2] ..... H01J 61/067; H01J 61/44

[52] U.S. Cl. ..... 313/484; 313/217; 313/491; 313/514

[58] Field of Search ..... 313/484, 514, 217, 486, 313/491; 315/169 TV

[56] References Cited

U.S. PATENT DOCUMENTS

| | | | |
|---|---|---|---|
| 3,612,938 | 10/1971 | DeBoer et al. | 315/169 R X |
| 3,619,700 | 11/1971 | Kupsky | 313/217 |
| 3,622,829 | 11/1971 | Watanabe | 315/169 X |
| 3,771,008 | 11/1973 | Chen et al. | 313/217 X |
| 3,836,810 | 9/1974 | Johanns et al. | 313/484 |
| 3,875,422 | 4/1975 | Wasa et al. | 313/484 X |
| 3,956,667 | 5/1976 | Veith | 315/169 TV |

OTHER PUBLICATIONS

"Luminescent Display Device," by B. Kazan, IBM Tech. Disclosure Bulletin, vol. 14, No. 5, (Oct. 1971), p. 1474.

*Primary Examiner*—Palmer C. Demeo

*Attorney, Agent, or Firm*—Oblon, Fisher, Spivak, McClelland & Maier

[57] ABSTRACT

Display system using low energy electrons which are produced in the discharge of gases (plasma). For this purpose there is formed a matrix of cells each comprising a cathode, a glass block, hollowed out in its center for receiving a plasma of helium, an assembly constituted by an anode and a luminophore support separated by an insulator, and a grid wire coated with an insulator. The electrons of the plasma excite or do not excite the luminophore, depending on the potential applied to the grid which performs the function of a control electrode and storage element.

6 Claims, 4 Drawing Figures

DISPLAY SYSTEM USING LOW ENERGY ELECTRONS

The invention relates to a flat screen display system using low energy electrons produced in the course of the electric discharge in a gas, that is to say in a plasma. The object of the invention is to produce a system of this type which has a storage which may be controlled from the exterior, the system being applicable to flat screen devices for display and television. Moreover, the system must be capable of reproducing all intermediate states between white (or the pure hue of a colored emission) and black (extinction), that is, it must possess a true "grey scale" (or half-tints).

Flat screen display systems are known which employ the properties of electric discharge in rare gases which may be grouped into two large categories:

(a) Panels operating with ac current of the "DIGI-VUE" type which is a registered trade mark. This panel has a "storage effect" but the obtainment of a true grey scale encounters great difficulties.

(b) "Self-sweeping" panels operating with dc current, in which a grey scale is obtained by varying the intensity of the current of the discharge in the light cell (elementary point), but such a device does not have its own storage means.

The invention overcomes these drawbacks.

According to the invention, there is provided a display system using low energy electrons, comprising elementary cells, each of them consisting of a certain amount of gas capable of contituting, upon electrical excitation, an electron generating plasma, and, disposed in said plasma, a cathode, an anode, an electrode covered with a luminophore substance capable of emitting photons when it receives electrons, and a grid capable of attracting the electrons produced by the plasma when it is brought to a potential which is sufficiently positive to eliminate all or a part of the electrons received by said electrode.

A better understanding of the invention will be had, and other features will appear, from the ensuing description and the accompanying drawings in which.

Figure 1:
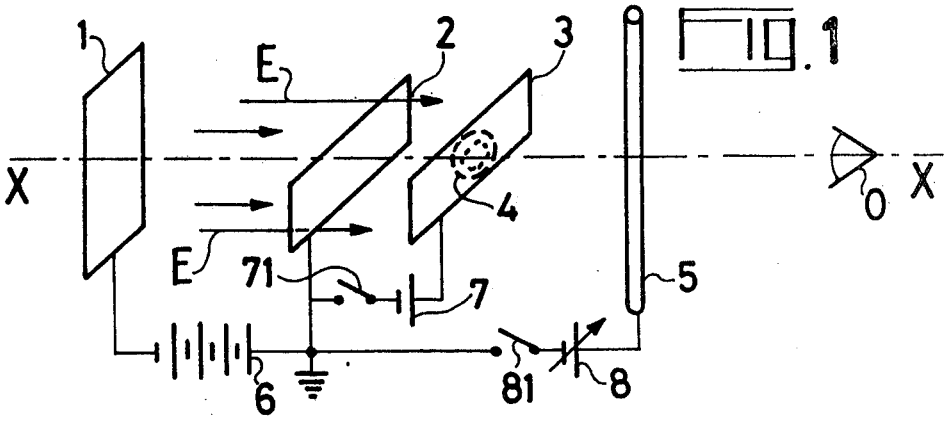
FIG. 1 illustrates the principle of the invention.

The principle of the invention is based on the following conception of an elementary display cell.

The following are disposed in an atmosphere of helium at a pressure of the order of 1 Torr, in succession on an axis XX (FIG. 1) oriented as indicated by the arrow in the direction from the cell toward the eye O of an observer:

- a cathode 1, for example of molybdenum;
- an anode 2, for example of molybdenum, of such dimensions that a part of the electrons of the plasma generated by the helium atmosphere are capable of issuing from the cathode-anode space (in the direction of the arrows E) when certain electric field conditions are met.
- a metallic electrode 3 on which there is disposed a luminophore for example of zinc oxide (Zn O) doped with zinc;

- a grid electrode 5 which may be a simple wire covered with an insulating sheath.

There may be applied between the cathode and the anode by means of a source 6, a difference of potential of for example 150 volts. If the anode is connected to the earth of the system, the cathode is connected to a − 150 terminal.

The electrode 3 may be connected to a + 20 volts terminal of a polarization source 7 whose negative terminal is connected to the anode with a possible cut-out by means of a switch 71.

The anode-cathode voltage is generally determined so that the discharge rate be of the so-called "abnormal" type in which the plasma current is substantially independent of the voltage.

The anode 2 and the luminophore 4 are placed in the discharge zone termed the "FARADAY zone".

The grid 5 is positively polarized by a dc voltage source which is, for example, variable from zero to + 30 volts, its earth terminal being connected to the anode with a possible cut-out by means of a switch 81.

Three states of luminescence are possible depending on the grid potential.

(A) "Full glow" or "pure hue", in the absence of grid polarization (state of rest) the electrons attracted by the + 20 V potential of the electrode 3 excite the luminophore which emits a green light in the case of zinc oxide doped with zinc.

(B) "Intermediate glow", "grey", or "half-tinged", for a potential of the grid between 0 and + 30 V, the part of the electrons deviated toward the grid being the greater as the potential of the latter is more positive.

(C) "Extinction" or "black" for a grid potential which is high enough to enable the grid to capture all of the electrons.

As concerns the storage, the writing, reading and erasing functions are performed in the following manner:

(1) Writing (or recording): it is effected with a negative modulation; indeed, the absence of positive voltage on the grid results in the full glow state. The positive value of a video signal results in a decrease in the glow which is the greater as this value is higher. The writing may be effected by sending pulses onto the grid, which has been represented symbolically by a switch 81, FIG. 1.

(2) Reading: it results in a display if the voltage of the source 7 is applied to the luminophores and may be deferred until a predetermined instant if a switch 71 is used. Moreover, it may be prolonged and thereby permit a display with a fixed image if the dc voltages are maintained on the electrodes 3 and 5.

(3) Erasing: this occurs spontaneously after a certain time corresponding to the natural discharge of the grid. In the case of television, the natural discharge time of the grid must distinctly exceed that of the frequency of reccurrence of the recordings (40 m sec. for the French standard). The dielectric must be chosen accordingly. The erasing can be produced by neutralizing the charge of the grid by means of a negative pulse applied to the grid.

Figure 2:
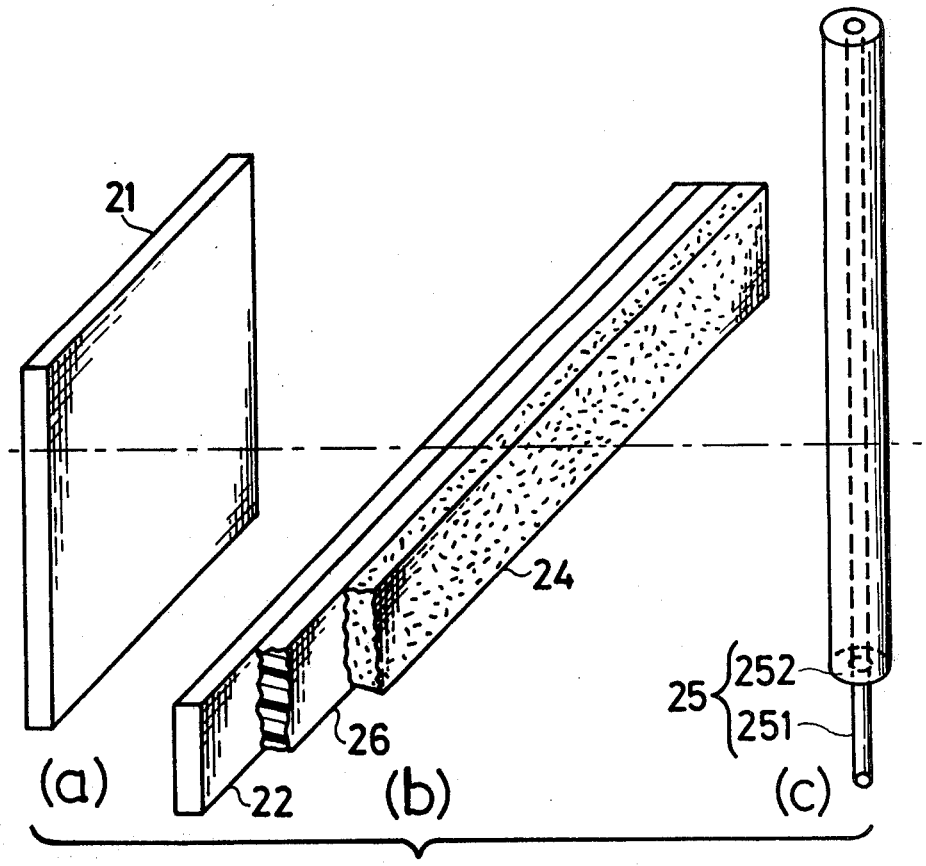
FIG. 2 represents an embodiment of the essential parts of the elementary cell of the system according to the invention.

In FIG. 2, there have been shown three essential parts or groups of parts of an elementary cell:

at (a), a cathode 21 constructed in the form of a square plate of molybdenum, this metal having been chosen owing to its good resistance to the phenomenon of cathodic pulverisation which is inevitable in the plasma; this cathode is disposed perpendicular to the axis XX, identical to that which has already been shown in FIG. 1;

at (b), an assembly of three adjoining rectangular plates comprising an anode 22 of molybdenum, a layer of polytetrafluorethylene 26, and an electrode 24 carrying a layer of luminophore zinc oxide; the rectangular shape, which has a small side less than the side of the square of the cathode 21, facilitates the issuing of the electrons from the cathode-anode space for the purpose of the excitation of the luminophores;

at (c), a grid 25 constituted by a metal wire 251 surrounded by an insulation (polytetrafluorethylene); the grid crosses perpendicularly the axis XX and remains parallel to the small side of the rectangles 22, 24 and 26; the distance there between and the anode is so determined that it has a sufficient and substantially uniform action on the electrons of the luminophore distributed on the electrode 24.

Figure 3:
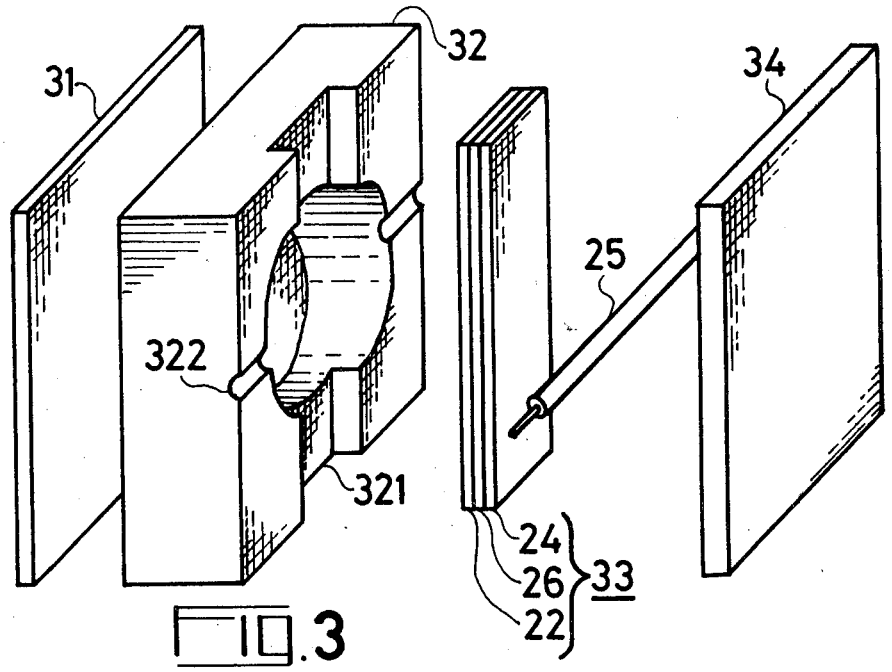
FIG. 3 is an exploded view of the complete cell.

FIG. 3 is an exploded view of an embodiment of an elementary cell. A glass block 32 is hollowed out in its centre for receiving helium. Deposited on one of its sides (opposed to the hollow) is a metallic layer constituting a cathode 31. Formed on the side opposed to the cathode are recesses 321 for receiving the anode and recesses 322 for receiving the grid. In practice, all the cells of the same screen would be obtained from the same plate of glass in which the hollows and then the recesses would be formed in succession.

After placing the assembly 33 (anode 22, insulator 26 and luminophore support 24) in normal position, a glass plate 34 is sealed, this plate constituting the front face of the display cell. In practice, there would be only one glass plate for the matrix of cells constituting the flat screen.

Figure 4:
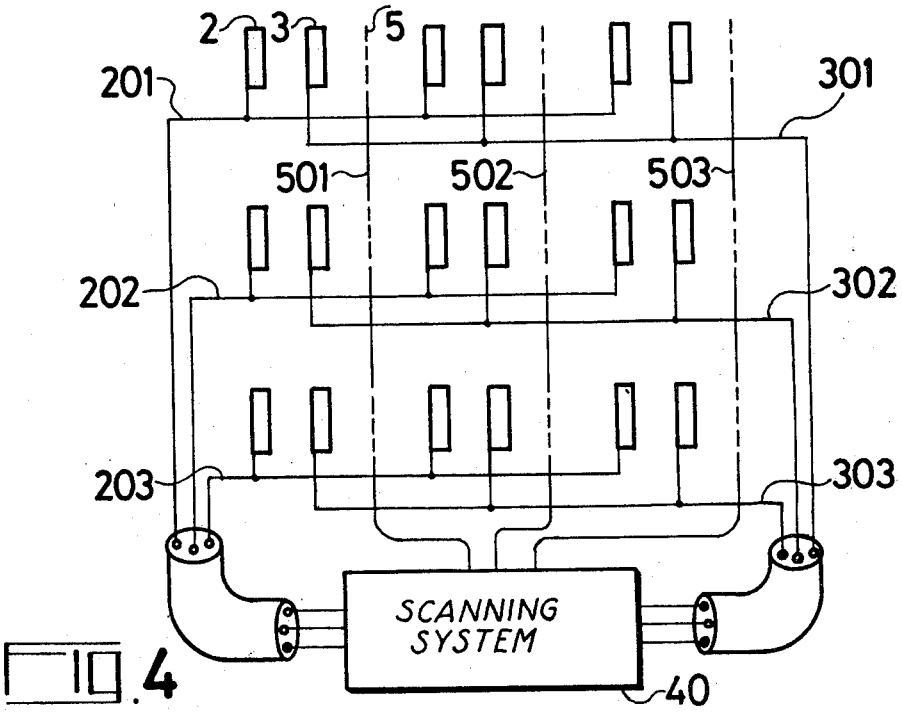
FIG. 4 represents a diagram of a display matrix according to the invention.

FIG. 4 shows diagrammatically a matrix of 9 cells by way of a non-limitative example. The cathode, common to all the cells, has not been shown. The anodes 2 of the successive lines are controlled by three anode conductors 201, 202 and 203 (one per line). The luminophores 3 of the successive lines are controlled by three other conductors 301, 302 and 303 which are insulated from the other anode conductors. The grids 5 of the same column are controlled by a column wire, namely 501 to 503 for the chosen example. All these conductors which are carefully insulated from one another, are connected to an electronic scanning system 40 which performs the following functions:

writing of the information by the grid lines;

reading of the information, and possibly erasing, by the anode lines;

extinction during the recording of a line by the conductors 301, 302 and 303.

The invention is applicable to flat television screens. For three colours, three luminophores would be employed to constitute triplets.

What we claim is:

1. A display system comprising:

a first transparent insulating plate member in which recesses have been cut out, said recesses forming a matrix with rows and columns, and being filled with a gas at such a pressure that said gas forms an ionic plasma in an electric field, said member bearing a first and a second series of notches forming lines intersecting one another at the centers of said recesses, the notches of the first series being laid out in lines parallel to rows of said matrix, and the notches of the second series being laid out in lines parallel to columns of said matrix;

a first series of electrodes sunk in the first series of notches, said electrodes being made of strips comprising starting from the bottoms of the notches a thin metallic plate to function as an anode, a layer of insulating material and a layer of a material containing phosphors capable of emitting visible light when receiving ions from said plasma;

a second series of electrodes sunk in the second series of notches, said electrodes being made of metallic wires each covered with a layer of an insulating material, each wire functioning as a grid, and said layer having a thickness calculated to allow the charge and the discharge of said grids with said ions in the duration of a predetermined time;

a metallic layer disposed upon the surface of said member opposite to said recesses, said layer functioning as a cathode;

a second transparent insulating plate member covering the recesses of said first member;

means for sealing said first and second members to form a sealed envelope;

whereby said anode and said cathode form a plasma;

and whereby a variable voltage applied between said grid and said anode allows ions to issue from the cathode-anode space and fall upon phosphors contained in said strips.

2. A system as claimed in claim 1 wherein said first and second members are made of glass.

3. A system as claimed in claim 1 wherein said gas is helium at a very low pressure.

4. A system as claimed in claim 1 wherein said anode and said cathode are made of molybdenum.

5. A system as claimed in claim 1 wherein said grid is made of copper wire covered with a layer of polytetrafluoroethylene.

6. A system as claimed in claim 1 wherein said phosphors are made of zinc oxide (ZnO) doped with zinc.

* * * * *